United States Patent [19]

Arnold

[11] Patent Number: 4,771,258

[45] Date of Patent: Sep. 13, 1988

[54] MOLDED CASE CIRCUIT BREAKER BIMETAL WITH HIGH CALIBRATION YIELD

[75] Inventor: David Arnold, Chester, Conn.

[73] Assignee: General Electric Company, New York, N.Y.

[21] Appl. No.: 114,179

[22] Filed: Oct. 29, 1987

[51] Int. Cl.[4] ..... H01H 71/16; H01H 75/08

[52] U.S. Cl. ..... 337/77; 335/43; 335/45; 337/75

[58] Field of Search ..... 337/77, 75; 335/43; 335/45

[56] References Cited

U.S. PATENT DOCUMENTS

| | | | |
|---|---|---|---|
| 2,847,532 | 8/1958 | Christensen et al. | 335/43 |
| 2,908,782 | 10/1959 | Kiesel et al. | 335/43 |
| 3,599,130 | 8/1971 | Murai et al. | 335/43 |
| 4,622,530 | 11/1986 | Ciarcia et al. | 335/167 |
| 4,630,019 | 12/1986 | Maier et al. | 337/70 |
| 4,679,016 | 7/1987 | Ciarcia et al. | 335/132 |

*Primary Examiner*—H. Broome

*Attorney, Agent, or Firm*—Richard A. Menelly; Walter C. Bernkopf; Fred Jacob

[57] ABSTRACT

A molded case circuit breaker bimetal trip unit arrangement substantially reduces the variation in trip characteristics between circuit breakers employing the improved bimetal. The number of circuit breakers failing the in-line calibration test is correspondingly substantially reduced.

10 Claims, 3 Drawing Sheets

MOLDED CASE CIRCUIT BREAKER BIMETAL WITH HIGH CALIBRATION YIELD

BACKGROUND OF THE INVENTION

Molded circuit breaker operating mechanisms and trip units are evolving on a continuing basis in an attempt to completely automate the circuit breaker assembly process. U.S. Pat. No. 4,622,530 entitled "Circuit Breaker Assembly For High Speed Manufacture" describes one such molded case circuit breaker. The "calibration yield", that is, the number of circuit breakers that successfully pass an in-line circuit breaker calibration test assembled in accordance with the teachings contained within this Patent is in excess of ninety-five percent. The circuit breaker high calibration yield latch assembly, that interfaces between the circuit breaker trip unit and the circuit breaker operating mechanism, is designed to minimize the differences in the latching force produced by the circuit breaker latch mechanism.

U.S. Pat. No. 4,679,016 entitled "Interchangeable Mechanism For Molded Case Circuit Breaker" describes the use of the aforementioned high calibration yield latch assembly with circuit breakers having an operating mechanism that is designed for high speed manufacture. The precision alignment of the circuit breaker components, by robotic assembly, decreases the tolerances that would otherwise exist between the various components, when hand assembled. The precise alignment of the circuit breaker components along with the improved latch arrangement further decreases the number of circuit breakers rejected during the in-line calibration process. Both Applications are incorporated for purposes of reference and should be reviewed for the teachings contained therein.

U.S. patent application Ser. No. 941,974 filed Dec. 15, 1986, entitled "Molded Case Circuit Breaker Contact Arrangement" describes the elimination of the circuit breaker flexible braid conductor that is otherwise required for connecting the bimetal trip units with the circuit breaker movable contact arm. The drag resulting on the movable bimetal when such braided conductors are attached, can interfere with the circuit breaker's thermal calibration. This Application is incorporated herein for purposes of reference.

U.S. Pat. No. 4,630,019 entitled "Molded Case Circuit Breaker With Calibration Adjusting Means For a BiMetal" describes an intermediate control lever coupled to a relatively stationary portion of a bimetal to enable adjustment thereof without applying undue stress to the movable portion of the bimetal.

It has since been determined that the variation between bimetal trip units used in circuit breakers relates to the difficulty in welding the bimetal strip to the heater at exactly the same spot. This changes the fulcrum point at which the bimetal exerts its motive force on the circuit breaker trip bar and hence the amount of force applied thereto. The welding of the bimetal element to the heater, per se, thermally overstresses the bimetal causing a change in the bimetal's characteristics. This introduces inaccuracies into the active area of the bimetal available for responding to predetermined overcurrent values during the circuit breaker calibration process.

One purpose of the instant invention is accordingly to provide a bimetal trip unit arrangement whereby the active region of the bimetal is unaffected by thermal over-stress conditions occurring during the welding process. A further purpose of this invention is to set the exact location of the fulcrum point along the bimetal.

SUMMARY OF THE INVENTION

A bimetal trip element contains a conductive metal heater welded thereto at one end. A hemispherical projection is impressed on the conductive metal heater to contact the bimetal at a point intermediate the welded region of the bimetal and its opposite free end. The hemispherical projection mechanically stresses the bimetal to minimize the effect of thermal stress during the welding operation and precisely sets the fulcrum point at which the bimetal responds for temperature deflection purposes.

DESCRIPTION OF THE PREFERRED EMBODIMENT

Figure 1:
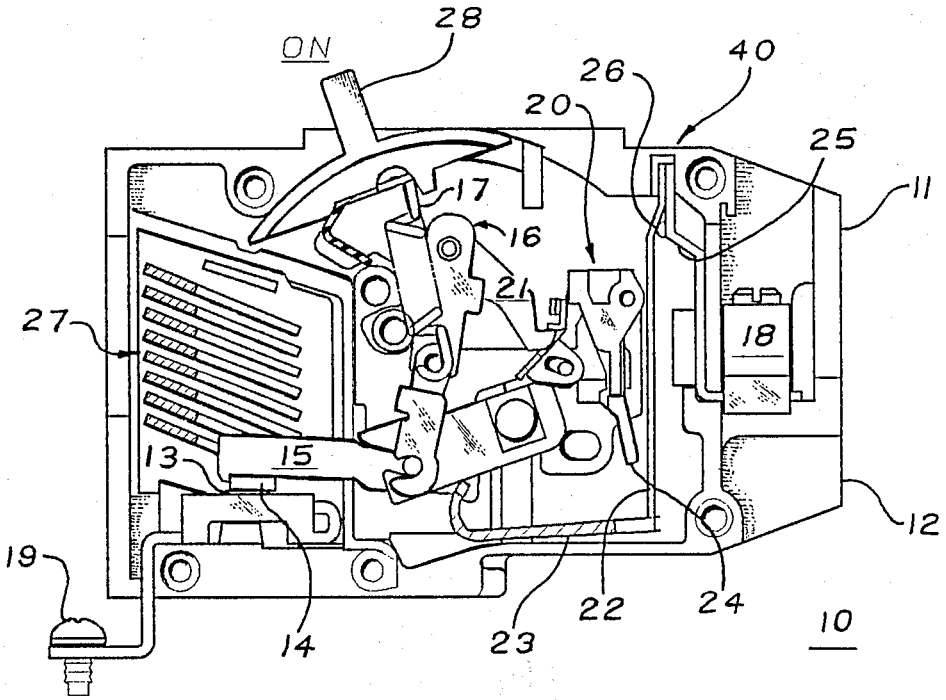
FIG. 1 is a cut-away side view of a molded case circuit breaker employing a directly heated bimetal trip unit according to the invention.

A molded case circuit breaker 10 is shown in FIG. 1 comprising a cover 11 and a case 12 with part of the case and cover removed to show the interior components contained therein. The components include a fixed contact 13 and a movable contact 14 attached to an operating mechanism 16 by means of a movable contact arm 15. The operating mechanism is refrained from driving the movable contact arm and movable contact to the open position under the bias provided by a pair of powerful operating springs 17 by interference between the cradle 21 and the latch system 20. An explanation of the operation of the latch system is found in the aforementioned U.S. Pat. No. 4,622,530. The load lug 18 is connected with an external power distribution circuit such that circuit current transfers through a directly heated trip unit 40 consisting of a load strap 25 and directly heat bimetal 22 and from there via a braid contact 23 to the movable contact arm 15 and contacts 13, 14 to the line terminal screw 19. The directly heated bimetal 22 upon the occurrence of an overcurrent condition then contacts the trip bar 24 to articulate the operating mechanism to separate the contacts. Upon the separation of the contacts, the arc that occurs therebetween is quickly extinguished within the arc chute 27 to completely interrupt the circuit current. The operating mechanism is separately controlled by means of an operating handle 28 depicted with the contacts in their "ON" condition. To accurately set the temperature at which the directly heated bimetal 22 responds to such overcurrent conditions, a hemispherical projection 26 is formed on the load strap 25 in a manner to be described below in greater detail.

Figure 2:
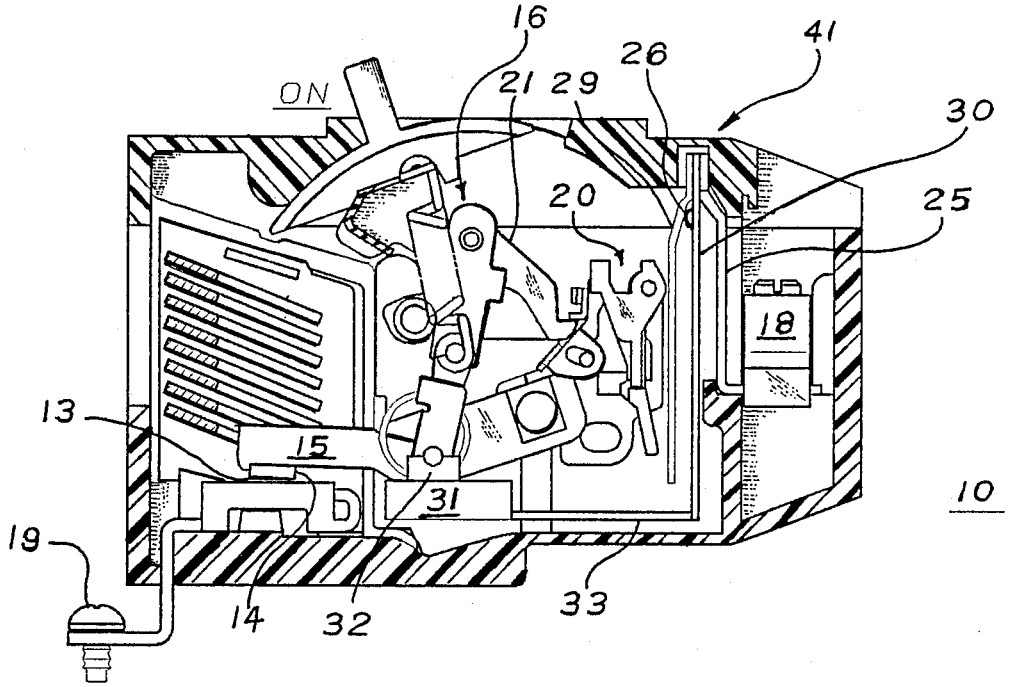
FIG. 2 is a cut-away side view of a molded case circuit breaker employing an indirectly heated bimetal trip unit according to the invention.

A molded case circuit breaker 10 is shown in FIG. 2 with a load lug 18 connecting with the line terminal screw 19, contacts 13, 14 and movable contact arm 15 through a contact support 31. This arrangement does not require a flexible braided conductor like that described earlier with the directly heated bimetal 22. As described in the aforementioned U.S. patent application Ser. No. 941,974 entitled "Molded Case Circuit Breaker Contact Arrangement" a contact blade 32 directly connects with the movable contact arm 15 and connects with the heater 30 by means of a fixed conductor 33. The heater connects with the load lug 18 by means of a load strap 25 and the indirectly heated bimetal 29 contacts a similar hemispherical projection 26 formed on the heater 30. The arrangement of the projection 26 and its function with respect to the precise response of the indirectly heated bimetal 29 will be discussed below in greater detail. The breaker operates in a similar manner to the directly heated circuit breaker depicted in FIG. 1 whereby an operating mechanism 16 interfaces with a latch assembly 20 by means of a cradle 21. The indirectly heated trip unit 41 includes the load strap 25, heater 30 and the indirectly heated bimetal 29 which are assembled to the contact arm support 31 in the manner best seen by referring now to FIG. 3.

Figure 3:
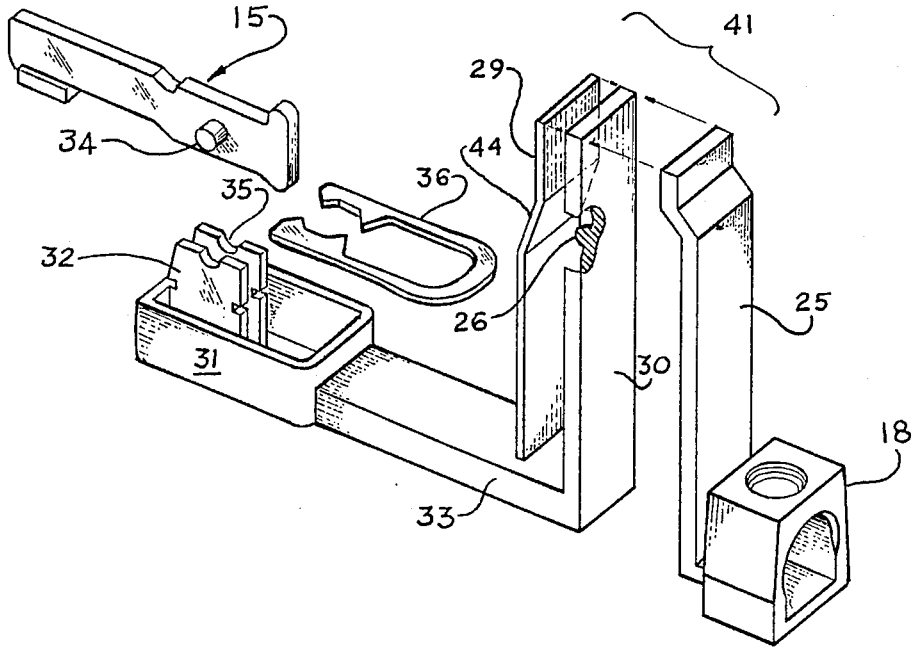
FIG. 3 is a top perspective view in isometric projection of the indirectly heated bimetal trip unit of FIG. 2 prior to assembly.

In FIG. 3, the contact arm support 31 is shaped from a single metal plate into a pair of upstanding contact arm blades 32 with a corresponding pair of grooves 35 formed on a top surface thereof. The movable contact arm 15 is assembled on the contact arm support 31 by positioning the pivot pin 34 within the grooves 35 and is held therein by means of the contact retainer spring 36. A fixed conductor 33 consisting of an angled copper bar with the vertical part of the bar forming the heater 30 and with the horizontal part of the bar directly welded or brazed to the contact arm support 31. The hemispherical projection 26 is formed proximate the top surface of the heater by means of a metal stamping operation and the indirectly heated bimetal 29, with an offset 44 formed opposite thereof, is welded to the top surface of the heater. The load strap 25 with the load lug 18 attached thereto is next welded to the heater on an opposite surface from the welded region of the indirectly heated bimetal 29.

Figure 4A:
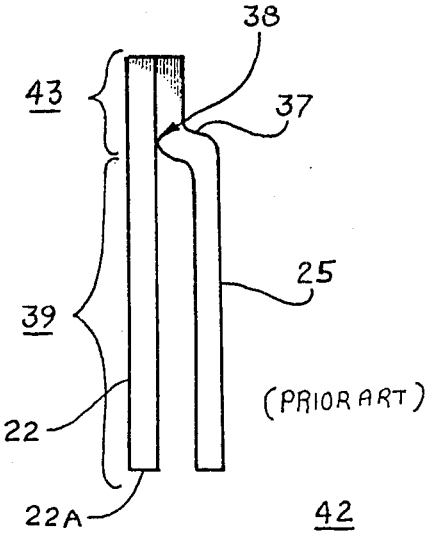
FIG. 4A is a side view of a directly heated bimetal trip unit according to the prior art.
Figure 4B:
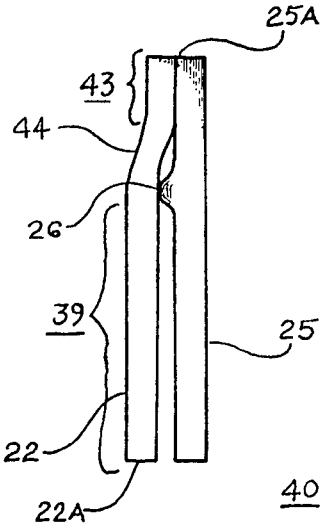
FIG. 4B is a side view of the directly heated bimetal trip unit of FIG. 1 according to the invention.

The significance of the hemispherical projection 26 can be seen by now referring to both FIGS. 4A and 4B. A prior art trip unit 42 is depicted in FIG. 4A with the load strap 25 defining an offset 37 proximate the pivot point defined at 38 for the directly heated bimetal 22 which is attached to the load strap in the vicinity of the welded region defined at 43. The welded region has unpredictable thermal response due to overstressing caused by the high temperatures generated during the welding process. The region 39 of the directly heated bimetal coextensive with the load strap 25 is accordingly defined as the "active" region of the bimetal. The bimetal then responds to temperatures generated therein by moving about the pivot point 38 which acts as a fulcrum for the force delivered on the trip bar 24 of FIG. 1 by the end of the bimetal 22A. Because of the uncertainties involved in the exact pivot point 38, when the load strap 25 is welded to the directly heated bimetal 22, the force generated by the movement of the directly heated bimetal about the pivot point 38 is somewhat uncertain. This uncertainty causes a variation in the calibration of the prior art trip unit 42 when undergoing such calibration process during manufacture as described within the aforementioned U.S. patent entitled "Circuit Breaker Assembly for High Speed Manufacture".

In order to provide an exact force response to the directly heated bimetal 22, the directly heated trip unit 40 shown in FIG. 4B is employed within the circuit breaker depicted in FIG. 1. The hemispherical projection 26 is formed at a predetermined distance from the end 25A of the load strap 25 such that the welded region 43 no longer determines the pivot point which is now exactly defined by the hemispherical projection 26 itself. An offset 44 is formed within the directly heated bimetal 22 in order to assure that the bimetal is directly contacted by the hemispherical projection. The active region 39 now exactly pivots about the hemispherical projection 26 at an accurately defined fulcrum for the force exerted by the end 22A of the directly heated bimetal. It has also been determined that the directly heated bimetal becomes precisely stressed by the pressure exerted upon the indirectly heated bimetal by the hemispherical protrusion 26. This eliminates and overrides any stress to the directly heated bimetal which occurs during welding within the welded region 43. Although the hemispherical projection is shown formed within the load strap 25 in FIG. 1 and within the heater 30 in FIG. 2 in some circuit breaker designs it is more convenient to form the hemispherical projection 26 on the directly heated bimetal 22 or the indirectly heated bimetal 29 associated with the load strap and heater respectively.

It has thus been shown that directly and indirectly heated bimetal trip units can be manufactured having reproductive response characteristics to predetermined temperatures. The control over the response characteristics substantially reduces variations in thermal calibration of such trip units when used within molded case circuit breakers assembled in an automated manufacturing process.

Having thus described my invention, what I claim as new and desire to secure by Letters Patent is:

1. A molded case circuit breaker comprising:

a pair of separable contacts;

an operating mechanism arranged for separating said contacts by action of a pair of operating springs, said operating mechanism being prevented from separating said contacts by a latch assembly;

a thermally responsive element proximate said latch assembly and arranged for contacting a part of said latch assembly in response to overcurrent conditions through said contacts; and a heater element in electric circuit with said contacts and attached to a first end of said thermally responsive element, said heater element including protruding means formed on said heater element intermediate said heater element and said thermally responsive element at predetermined distance from said first end of said thermally responsive element for providing a predetermined fulcrum, said thermally responsive element being moved into contact with said latch assembly part about said predetermined fulcrum upon occurrence of said overcurrent conditions through said contacts.

2. The molded case circuit breaker of claim 1 wherein said thermally responsive element comprises a bimetal.

3. The molded case circuit breaker of claim 1 wherein said heater element is welded to said thermally responsive element.

4. The molded case circuit breaker of claim 1 wherein said providing means comprises a hemispherical protrusion.

5. A molded case circuit breaker comprising:

a pair of separable contacts;

an operating mechanism arranged for separating said contacts by action of a pair of operating springs, said operating mechanism being prevented from separating said contacts by a latch assembly;

a thermally responsive element proximate said latch and arranged for contacting a part of said latch assembly in response to overcurrent conditions through said contacts; and a load strap connecting between said thermally responsive element and an external electric circuit, said load strap including protruding means formed on said load strap intermediate said load strap and said thermally responsive element at a predetermined distance from one end of said thermally responsive element for providing a predetermined fulcrum, said thermally responsive element being moved into contact with said latch assembly part about said predetermined fulcrum upon occurrence of said overcurrent conditions through said contacts.

6. The circuit breaker of claim 5 wherein said thermally responsive means comprises a bimetal.

7. The circuit breaker of claim 5 wherein said load strap is welded to said thermally responsive element.

8. The circuit breaker of claim 5 wherein said protruding means comprises a hemispherical protrusion.

9. A molded case circuit breaker comprising:

a pair of separable contacts;

an operating mechanism arranged for separating said contacts by action of a pair of operating springs, said operating mechanism being prevented from separating said contacts by a latch assembly;

a thermally responsive element proximate said latch assembly and arranged for contacting a part of said latch assembly in response to overcurrent conditions through said contacts; and a heater element in electric circuit with said contacts and attached to a first end of said thermally responsive element, said thermally responsive element including protruding means formed on said thermally responsive element intermediate said heater element and said thermally responsive element at a predetermined distance from said first end of said thermally responsive element for providing a predetermined fulcrum, said thermally responsive element being moved into contact with said latch assembly part about said predetermined fulcrum upon occurrence of said overcurrent conditions through said contacts.

10. A molded case circuit breaker comprising:

a pair of separable contacts;

an operating mechanism arranged for separating said contacts by action of a pair of operating springs, said operating mechanism being prevented from separating said contacts by a latch assembly;

a thermally responsive element proximate said latch and arranged for contacting a part of said latch assembly in response to overcurrent conditions through said contacts; and a load strap connecting between said thermally responsive element and an external electric circuit, said thermally responsive element including protruding means formed on said thermally responsive element intermediate said load strap and said thermally responsive element at a predetermined distance from said one end of said thermally responsive element for providing a predetermined fulcrum, said thermally responsive element being moved into contact with said latch assembly part about said predetermined fulcrum upon occurrence of said overcurrent conditions through said contacts.

* * * * *